US006464620B1

(12) United States Patent
Hettrich

(10) Patent No.: US 6,464,620 B1
(45) Date of Patent: Oct. 15, 2002

(54) TRAINING APPARATUS FOR WALKING

(76) Inventor: Dirk Hettrich, 25 Stanford Pl., Montclair, NJ (US) 07042

( * ) Notice: Subject to any disclaimer, the term of this patent is extended or adjusted under 35 U.S.C. 154(b) by 0 days.

(21) Appl. No.: 09/442,117

(22) Filed: Nov. 17, 1999

(51) Int. Cl.[7] ..... A47D 13/04; A61H 3/00

(52) U.S. Cl. ..... 482/51; 482/35; 434/255; 135/65

(58) Field of Search ..... 482/38, 51, 66–69; 434/255; 135/67, 71, 73, 65; D3/7, 8; 280/87.051

(56) References Cited

U.S. PATENT DOCUMENTS

| | | | | | |
|---|---|---|---|---|---|
| 1,332,461 | A | * | 3/1920 | Bowden | 482/51 |
| 2,545,009 | A | * | 3/1951 | Spiteri | 482/51 |
| 2,861,582 | A | * | 11/1958 | Miller | 135/71 |
| 3,237,939 | A | * | 3/1966 | Olivet et al. | 482/69 |
| 3,529,819 | A | * | 9/1970 | Blank | 482/68 |
| 4,251,105 | A | * | 2/1981 | Barker | 135/67 |
| 4,907,972 | A | * | 3/1990 | Marolda | 434/255 |
| 5,329,954 | A | * | 7/1994 | Miyoshi | 135/71 |
| 5,555,904 | A | * | 9/1996 | Stockwell | 135/68 |
| 5,564,451 | A | * | 10/1996 | Hagberg | 135/68 |
| 5,673,719 | A | * | 10/1997 | Shofner | 135/68 |
| 6,196,949 | B1 | * | 3/2001 | Rodarte | 482/69 |

* cited by examiner

*Primary Examiner*—Mickey Yu
*Assistant Examiner*—Victor Hwang
(74) *Attorney, Agent, or Firm*—Charles E. Baxley, Esq.

(57) ABSTRACT

A training apparatus for walking includes a pair of identical support assemblies each of which has a generally vertical member, the upper end of which is connected to a generally horizontal member. An end of the horizontal member includes a loop which accepts the forearm of a user. The user walks with the apparatus in a manner similar to walking with a pair of canes while a child grasps the vertical members and gains confidence while learning to walk.

14 Claims, 3 Drawing Sheets

TRAINING APPARATUS FOR WALKING

FIELD OF THE INVENTION

The present invention relates generally to the field of training apparatuses and more particularly to a training apparatus for walking.

BACKGROUND OF THE INVENTION

Adults typically teach young children to walk by holding the child's hands and walking behind the child while encouraging the child to move his or her legs in a walking motion. Typically, the child's hands are held in a raised and awkward position for extended periods of time. In order to prevent the child from falling, the adult often pulls upwardly on the child's hands resulting in a degree of discomfort.

As a result in the disparity between the height of the child and the adult, the adult typically walks behind the child with his or her back bent to accommodate the child's height. This results in a significant degree of discomfort for the adult. In addition, the child often trips and stumbles over the adult's feet.

OBJECTS AND SUMMARY OF THE INVENTION

It is therefore an object of the present invention to provide a training apparatus for walking which enables an adult to teach a child to walk in a convenient manner.

Another object of the present invention is to provide a training apparatus for walking which accommodates the height of the adult and which enables the adult to walk upright.

Another object of the present invention is to provide a training apparatus for walking which is adjustable.

Yet another object of the present invention is to provide a training apparatus which comprises a relatively small number of component parts, each of which can be manufactured economically in volume resulting in a relatively low overall cost and reliable long term operation.

The foregoing and other objects and advantages of the present invention will appear more clearly hereinafter.

In accordance with the present invention there is provided a training apparatus for walking which includes a pair of identical support assemblies, each of which has a generally vertical member, the upper end of which is connected to the first end of a generally horizontal member. The second end of the horizontal member includes a loop which is proportioned to accept the forearm of a user. An intermediate portion of the horizontal member includes a handle.

Alternative embodiments of the invention include an adjustment assembly which is used to adjust the length of the vertical member. An additional alternative embodiment includes a transverse member which connects the two horizontal members.

During use, the adult passes his or her forearms through the loops and grasps the handles on the horizontal members. The lower ends of the vertical members rest on the ground and the adult walks forward using the apparatus according to the present invention in a manner similar to walking with a pair of canes. The child stands between the vertical members and grasps the vertical members, thus supporting himself or herself while learning to walk.

DESCRIPTION OF THE DRAWINGS

Other important objects and advantages of the present invention will be apparent from the following detailed description taken in connection with the accompanying drawing wherein like numerals refer to like parts and in which.

DETAILED DESCRIPTION OF THE INVENTION

Figure 1:
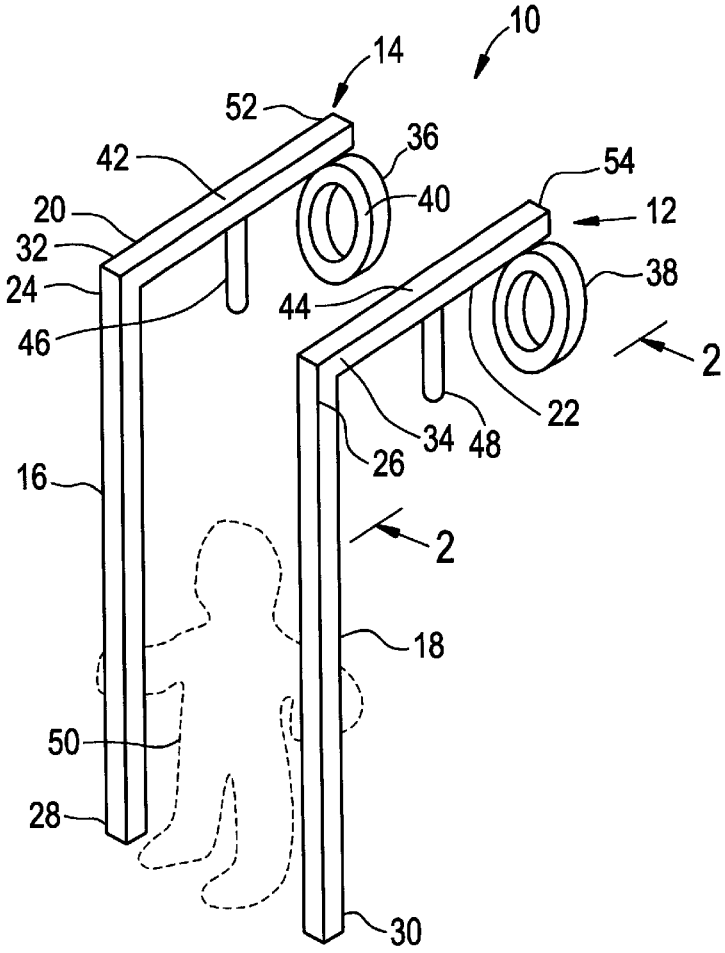
FIG. 1 is an overall perspective view of a training apparatus for walking made according to the present invention.
Figure 2:
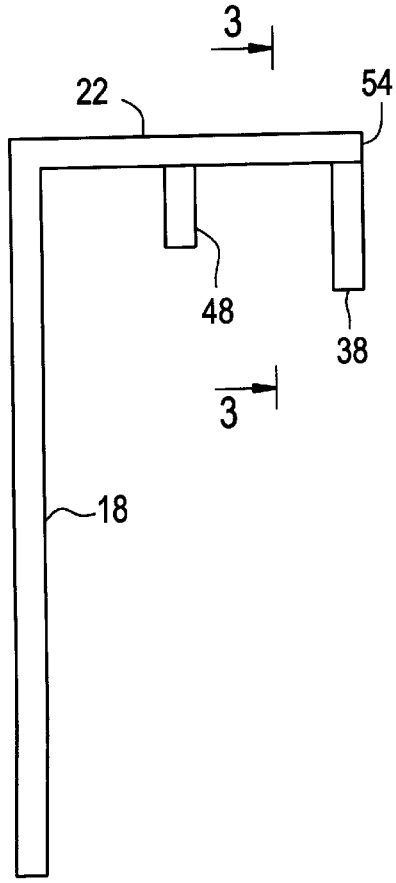
FIG. 2 is a side elevational view of the apparatus of FIG. 1, taken along line 2—2 of FIG. 1.
Figure 3:
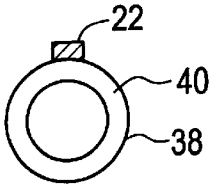
FIG. 3 is a cross-sectional view taken along line 3—3 of FIG. 2.

With reference to the drawings, wherein like reference numbers designate like or corresponding parts throughout, there is shown in FIGS. 1–7 a training apparatus for walking 10 made in accordance with the present invention.

The training apparatus for walking 10 includes a pair of identical support assemblies 12, 14 each of which has a vertical elongated member 16, 18 and an elongated horizontal member 20, 22. The vertical members 16, 18 each have an upper end 24, 26 and a lower end 28, 30. Horizontal members 20, 22 each have a first end 32, 34 and a second end 52, 54. Upper ends 24, 26 of vertical members 16, 18 are connected to first ends 32, 34 of the horizontal members 20, 22. The vertical 16, 18 and horizontal 20, 22 members are generally mutually perpendicular.

The vertical members 16, 18 and the horizontal 20, 22 members are rigidly joined to each other.

The second ends 52, 54 of the horizontal members 20, 22 each has a loop member 36, 38 mounted thereon. Each of the loop members 36, 38 is proportioned to accept a forearm of a user passing through a respective loop member 36, 38 and a theoretical plane defined by a surface 40 of the loop members 36, 38 which surface is generally perpendicular to the horizontal members 20, 22. The loop members alternately could take the form of hooks or straps.

The loop members 36, 38 are closed.

Intermediate portions 42, 44 of the horizontal members 20, 22 include downwardly projecting handles 46, 48.

The handles 46, 48 are normal to the horizontal members 20, 22.

Figure 5:
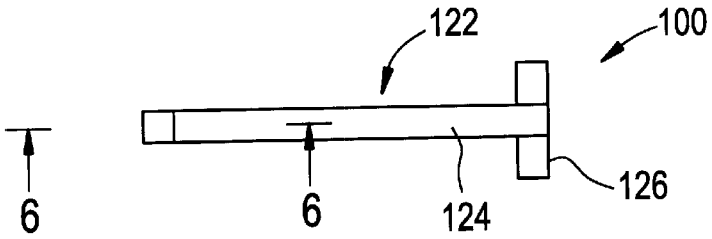
FIG. 5 is a top plan view taken along line 5—5 of FIG. 4.
Figure 4:
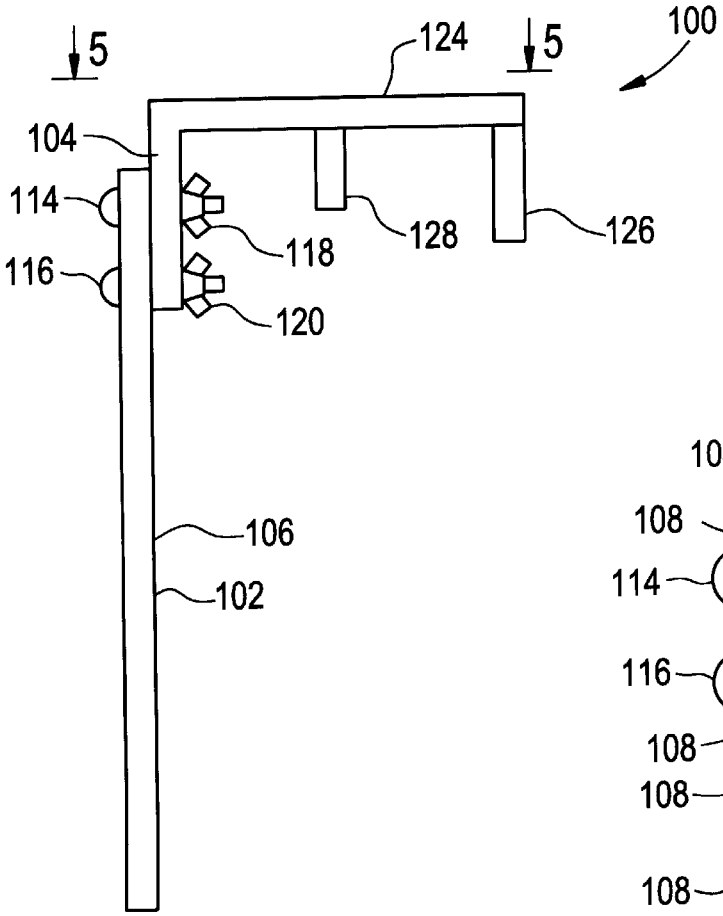
FIG. 4 is a side elevational view similar to FIG. 2, showing an alternative embodiment of the invention incorporating an adjustable vertical member.
Figure 6:
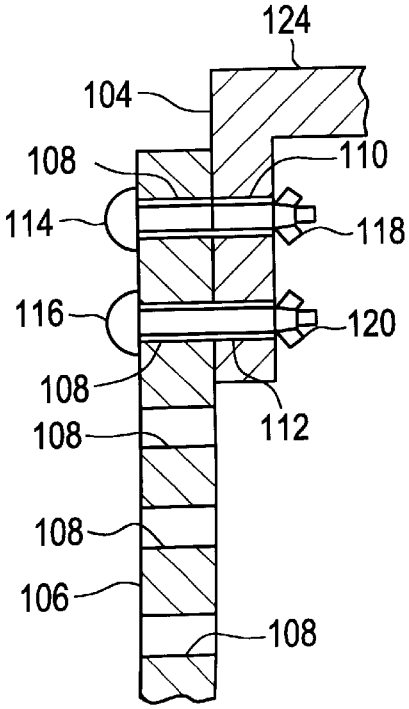
FIG. 6 is a fragmentary cross-sectional view taken along line 6—6 of FIG. 4 and drawn to an enlarged scale.

In an alternative embodiment of the invention 100 which is shown in FIGS. 4–6, a vertical member 102 comprises a first vertical member 104 and a second vertical member 106. Second vertical member 106 includes a linear array of holes 108 which are equally spaced. First vertical member 104 has a pair of holes 110, 112 having the same spacing as the holes 108 in the second vertical member 106. The first and second vertical members 104, 106, respectively, are connected by a pair of bolts 114, 116 and wing nuts 118, 120 which facilitate adjustment of the overall length of vertical member 102 thereby accommodating users of different heights.

The first vertical member 104 and the second vertical member 106 of the vertical member 102 are each slidable longitudinally relative to each other, whereby the height above the ground of the horizontal member 124 can be adjusted to a desired height.

The alternative embodiment 100 includes a pair of identical support assemblies, only one of which 122 has been shown in FIGS. 4–6. Support assembly 122 includes a horizontal member 124, a loop 126 and a handle 128 which are identical to the comparable components previously described in connection with the primary embodiment of the invention 10.

Figure 7:
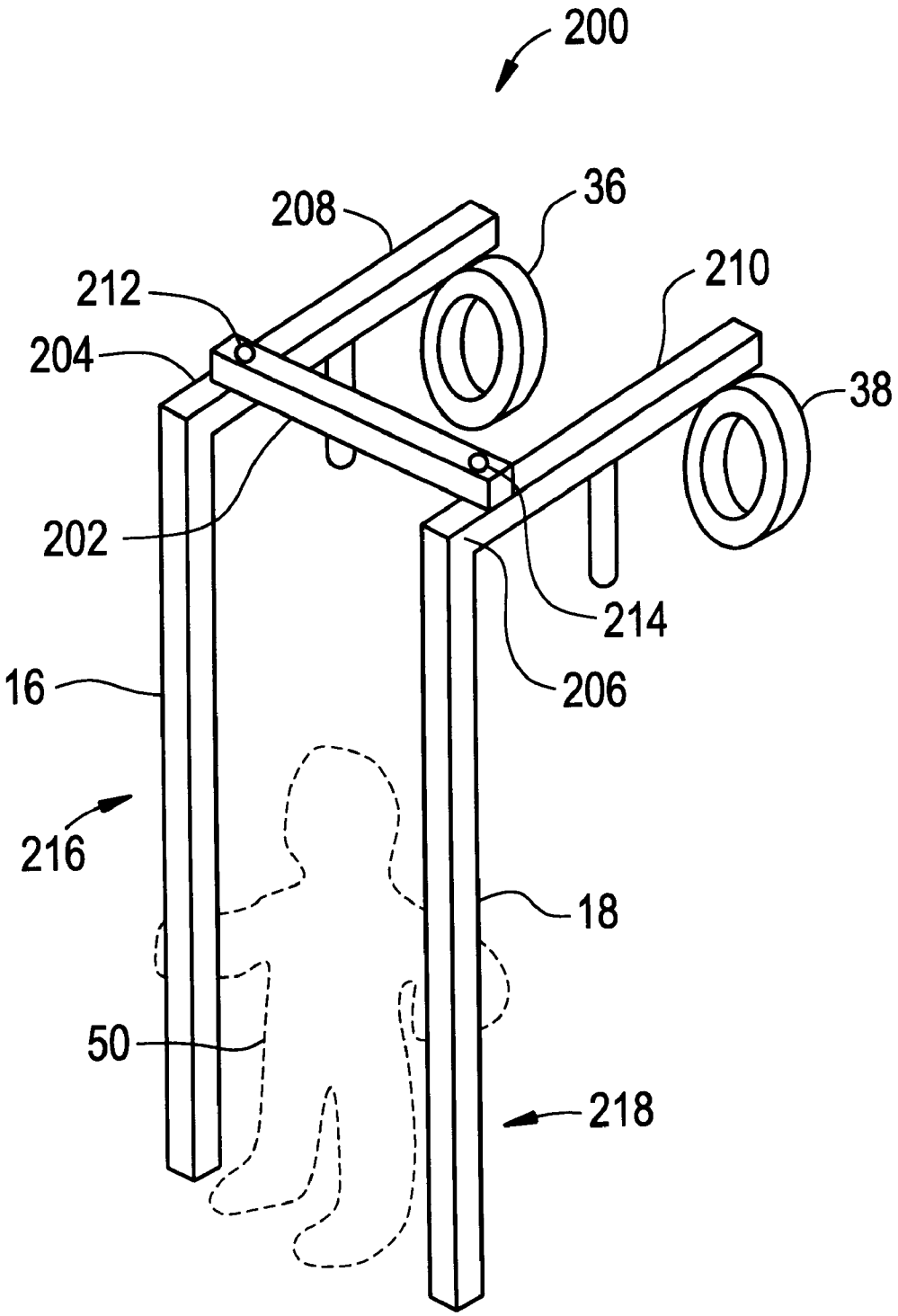
FIG. 7 is an overall perspective view showing another alternative embodiment of the invention incorporating a transverse member connecting the horizontal members.

FIG. 7 shows another alternative embodiment of the invention 200 which is similar to the embodiment 10 and which incorporates a transverse bar 202. The transverse bar 202 is pivotally connected to intermediate portions 204, 206 on horizontal members 208, 210 by pivots 212, 214.

The transverse bar 202 enables the user to easily maintain the distance between the support assemblies 216, 218 during use. Alternatively, the transverse bar 202 may be rigidly connected to the horizontal members 208, 210.

During use, an adult passes his or her forearms through the loops and grasps the handles 46, 48 on the horizontal members 20, 22. The lower ends 28, 30 of the vertical members 16, 18 rest on the ground and the adult walks forward using the apparatus 10 according to the present invention in a manner similar to walking with a pair of canes. As is shown in FIG. 1, a child 50 stands inbetween the vertical members 16, 18 and grasps the vertical members 16, 18 thus supporting himself or herself while learning to walk. The child 50 thus gains confidence in walking while the adult is able to provide assistance while walking upright in a comfortable manner.

By the adult passing his or her forearms through the loops 36, 38 and grasping the handles 46, 48, the adult can manually control positioning and inclination of the vertical members 16, 18. The manual movement of the vertical members 16, 18 can be performed by the adult by rotating the vertical members 16, 18 alternately about the lower ends 28, 30, respectively. The toddler 50 is encouraged to take walking steps one foot at a time while the adult manually moves the vertical members 16, 18 to advance alternately in stepwise progression with the walking steps of the toddler 50 while physically offering support to the toddler against falling and mentally securing the toddler against fear of falling.

The foregoing specific embodiments of the present invention as set forth in the specification herein are for illustrative purposes only. Various deviations and modifications can be made within the spirit and scope of this invention, without departing from the main theme thereof.

I claim:

1. A method for use by an ambulatory person to train a toddler to walk, said method comprising the steps of:

a) providing an upright left member having a lower left end for contacting the ground and an upper left end joined rigidly and normally to a left distal end of a trailing horizontal left member; said trailing horizontal left member having a left proximal end provided with a left loop adapted to receive a left forearm of the ambulatory person; said left trailing horizontal member also provided with a left handle situated between said left proximal end and said left distal end;

b) providing an upright right member having a lower right end for contacting the ground and an upper right end joined rigidly and normally to a right distal end of a trailing horizontal right member; said trailing horizontal right member having a right proximal end provided with a right loop adapted to receive a right forearm of the ambulatory person; said trailing horizontal right member also provided with a right handle situated between said right proximal end and said right distal end;

c) positioning the toddler between said upright left member and said upright right member with a left hand of the toddler capable of holding onto said upright left member and a right hand of the toddler capable of holding onto said upright right member;

d) inserting the ambulatory person's left forearm through said left loop with the ambulatory person's left hand capable of gripping said left handle, and inserting the ambulatory person's right forearm through said right loop with the ambulatory person's right hand capable of gripping said right handle, whereby the ambulatory person can manually control positioning and inclination of said upright left member and said upright right member; and e) encouraging the toddler to take walking steps one foot at a time while the ambulatory person manually moves said upright left member and said upright right member to advance alternately on stepwise progression with the walking steps of the toddler while physically offering support to the toddler against falling and mentally securing the toddler against fear of falling.

2. The method as claimed in claim 1; further comprising the steps of:

a) organizing said left handle normal to, and projecting downward from, said trailing horizontal left member; and b) organizing said right handle normal to, and projecting downwardly from, said trailing horizontal right member.

3. The method as claimed in claim 2; further comprising the steps of:

a) organizing said left loop to be closed; and b) organizing said right loop to be closed.

4. The method as claimed in claim 3; further comprising the steps of:

a) organizing said upright left member to have an upper left portion and a lower left portion each slidable longitudinally relative to each other and organizing said upright right member to have an upper right portion and a lower right portion each slidable longitudinally relative to each other, whereby height above the ground of said trailing horizontal right member and said trailing horizontal left member, respectively, can be adjusted; and b) providing attachment means for attaching said upper left portion to said lower left portion and for attaching said upper right portion to said lower right portion.

5. The method as claimed in claim 4; further comprising the step of connecting a transverse bar to join said trailing horizontal left member rigidly to said trailing horizontal right member, whereby the manual movement of said upright left member and said upright right member can be performed by the ambulatory person rotating said upright left member and said upright right member alternately about said left lower end and said right lower end, respectively.

6. An apparatus for use by an ambulatory person to train a toddler to walk, said apparatus comprising:

a) a generally upright member;

b) a trailing horizontal member;

c) a loop; and d) a handle;

wherein said trailing horizontal member has a proximal end;

wherein said trailing horizontal member has a distal end;

wherein said generally upright member has a lower end;

wherein said lower end of said generally upright member is for contacting the ground;

wherein said generally upright member has an upper end;

wherein said upper end of said generally upright member is joined rigidly to said distal end of said trailing horizontal member;

wherein said upper end of said generally upright member is joined normally to said distal end of said trailing horizontal member;

wherein said loop is provided on said proximal end of said trailing horizontal member; and wherein said handle extends from said trailing horizontal member and is situated between said proximal end and said distal end of said trailing horizontal member.

7. The apparatus as claimed in claim 6, wherein said handle is arranged normally to said trailing horizontal member; and wherein said handle projects downwardly from said trailing horizontal member.

8. The apparatus as claimed in claim 7, wherein said loop is closed.

9. The apparatus as claimed in claim 8, wherein said generally upright member has an upper portion;

wherein said generally upright member has a lower portion;

wherein said upper portion and said lower portion are slidable longitudinally relative to each other, whereby height above the ground of said trailing horizontal member can be adjusted; and wherein said generally upright member has attachment means for attaching said upper portion to said lower portion with said trailing horizontal member at a desired height.

10. An apparatus for use by an ambulatory person to train a toddler to walk, said apparatus comprising:

a) an upright left member;

b) a trailing horizontal left member;

c) a left loop;

d) a left handle;

e) an upright right member;

f) a trailing horizontal right member;

g) a right loop; and h) a right handle;

wherein said trailing horizontal left member has a left proximal end;

wherein said trailing horizontal left member has a left distal end;

wherein said upright left member has a lower left end;

wherein said lower left end of said upright left member is for contacting the ground;

wherein said upright left member has an upper left end;

wherein said upper left end of said upright left member is joined rigidly to said left distal end of said trailing horizontal left member;

wherein said upper left end of said upright left member is joined normally to said left distal end of said trailing horizontal left member;

wherein said left loop is provided on said left proximal end of said trailing horizontal left member;

wherein said left loop is adapted to receive a left forearm of the ambulatory person;

wherein said left handle extends from said trailing horizontal left member and is situated between said left proximal end and said left distal end of said trailing horizontal left member;

wherein said trailing horizontal right member has a right proximal end;

wherein said trailing horizontal right member has a right distal end;

wherein said upright right member has a lower right end;

wherein said lower right end of said upright right member is for contacting the ground;

wherein said upright right member has an upper right end;

wherein said upper right end of said upright right member is joined rigidly to said right distal end of said trailing horizontal right member;

wherein said upper right end of said upright right member is joined normally to said right distal end of said trailing horizontal right member;

wherein said right loop is provided on said right proximal end of said trailing horizontal right member;

wherein said right loop is adapted to receive a right forearm of the ambulatory person;

wherein said right handle extends from said trailing horizontal right member and is situated between said right proximal end and said right distal end of said trailing horizontal right member; and wherein said upright left member and said upright right member are spaced apart from each other to accommodate the toddler to stand therebetween with a left hand of the toddler capable of holding onto said upright left member and a right hand of the toddler capable of holding onto said upright right member.

11. The apparatus as claimed in claim 10, wherein said left handle is normal to said trailing horizontal left member;

wherein said left handle projects downwardly from said trailing horizontal left member;

wherein said right handle is normal to said trailing horizontal right member; and wherein said right handle projects downwardly from said trailing horizontal right member.

12. The apparatus as claimed in claim 11, wherein said left loop and said right loop are each closed.

13. The apparatus as claimed in claim 12, wherein said upright left member has an upper left portion;

wherein said upright left member has a lower left portion;

wherein said upright right member has an upper right portion;

wherein said upright right member has a lower right portion;

wherein said upper left portion and said lower left portion are slidable longitudinally relative to each other and said upper right portion and said lower right portion are slidable longitudinally relative to each other, whereby height above the ground of said trailing horizontal left member and said trailing horizontal right member, respectively, can be adjusted; and further comprising attachment means for attaching said upper left portion to said lower left portion and for attaching said upper right portion to said lower right portion with said trailing horizontal left member and said trailing horizontal right member at a desired height.

14. The apparatus as claimed in claim 13; further comprising a transverse bar; and wherein said transverse bar joins said trailing horizontal left member to said trailing horizontal right member.

* * * * *